US007661417B2

(12) United States Patent
Stewart et al.

(10) Patent No.: US 7,661,417 B2
(45) Date of Patent: Feb. 16, 2010

(54) AIR PRESSURE BOOST ASSIST

(75) Inventors: Ted Stewart, Ponte Vedra Beach, FL (US); James Napier, Atlantic Beach, FL (US)

(73) Assignee: Advanced Global Equities and Intellectual Properties, Inc., Atlantic Beach, FL (US)

( * ) Notice: Subject to any disclaimer, the term of this patent is extended or adjusted under 35 U.S.C. 154(b) by 0 days.

(21) Appl. No.: 11/685,473

(22) Filed: Mar. 13, 2007

(65) Prior Publication Data

US 2007/0289574 A1 Dec. 20, 2007

Related U.S. Application Data

(60) Provisional application No. 60/786,803, filed on Mar. 28, 2006.

(51) Int. Cl.
*F02B 29/00* (2006.01)

(52) U.S. Cl. ..... 123/585; 123/586

(58) Field of Classification Search ..... 123/402, 123/405, 585, 586

See application file for complete search history.

(56) References Cited

U.S. PATENT DOCUMENTS 3,020,901 A * 2/1962 Cook ..... 123/559.1
3,878,400 A * 4/1975 McSparran ..... 290/14
4,554,890 A * 11/1985 Okimoto et al. ..... 123/26
4,634,887 A * 1/1987 Balch et al. ..... 290/3
4,738,233 A * 4/1988 Hitomi et al. ..... 123/405
4,998,951 A * 3/1991 Kawamura ..... 60/608
5,064,423 A * 11/1991 Lorenz et al. ..... 60/611
5,299,547 A * 4/1994 Michimasa ..... 123/559.1
5,819,538 A * 10/1998 Lawson, Jr. ..... 60/611
6,055,808 A * 5/2000 Poola et al. ..... 123/585
6,173,567 B1 * 1/2001 Poola et al. ..... 60/274
6,564,172 B1 * 5/2003 Till ..... 702/182
6,826,910 B1 * 12/2004 Easton ..... 60/597
2003/0187553 A1 * 10/2003 Dillen et al. ..... 701/19
2004/0055585 A1 * 3/2004 Smolarek et al. ..... 123/585
2004/0145187 A1 * 7/2004 Dillen et al. ..... 290/41
2005/0145222 A1 * 7/2005 Glenn et al. ..... 123/501

* cited by examiner

*Primary Examiner*—Erick Solis
(74) *Attorney, Agent, or Firm*—Schmid PA

(57) ABSTRACT

Disclosed is an electronic module designed to use the locomotive engine's speed sensors to detect such changes in engine speed (rpm), as required by the locomotive operator moving the throttle notch handle. Once a speed change is detected, the module commands an air valve on each of the locomotive's main air reservoir tanks, (designed to handle the normal operating main reservoir air pressure), to open and allow them to discharge into the engine's intake manifolds located on both sides of the diesel engine.

1 Claim, 1 Drawing Sheet

AIR PRESSURE BOOST ASSIST

CROSS-REFERENCE TO RELATED APPLICATION

Figure 1:
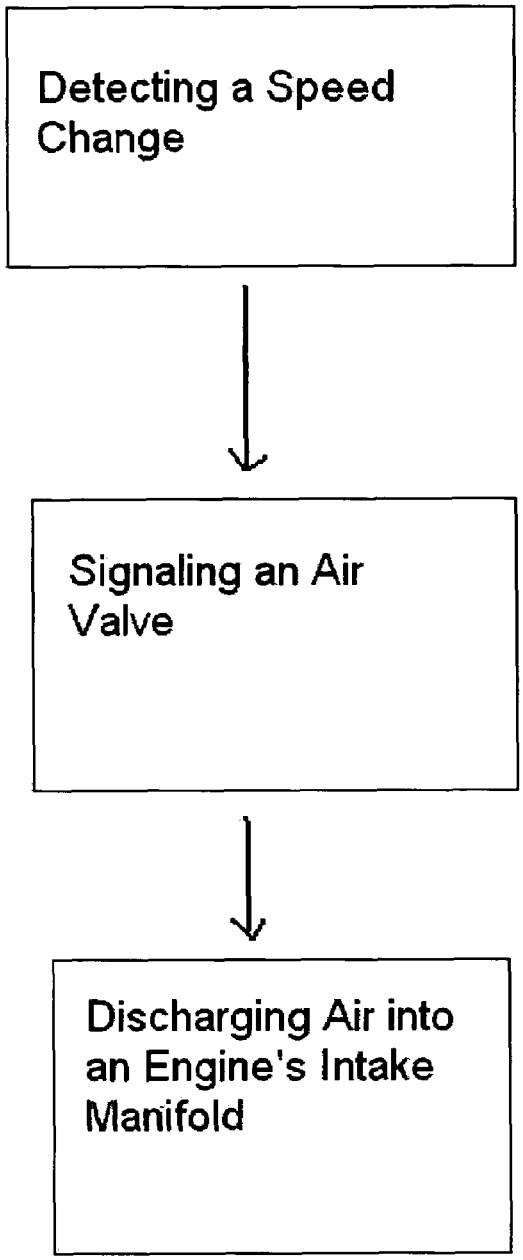

This application claims priority to U.S. Provisional Patent Application Ser. No. 60/786,803 filed Mar. 28, 2006, the contents of which are hereby incorporated in their entirety.

ABSTRACT

The prevent invention provides an intake manifold air pressure boost using a locomotive's main reservoir air supply during diesel engine speed and load transition periods during throttle notch changes.

BACKGROUND

GE locomotive diesel engines are susceptible to short period bursts of high visible smoke levels during throttle notch changes, (speed and load fluctuations).

During these throttle notch changes, the loading demands on the engine are such that the combustion fuel/air ratio is extremely rich, thus creating the situation where the fuel is inefficiently burned resulting in high levels of visible smoke from the locomotive's exhaust muffler or stack.

DRAWING

FIG. 1 is a block flow diagram of the present method and apparatus for detecting a speed change and signaling an air valve to discharge air into an engine's intake manifold.

DESCRIPTION

In order to offset the condition described above, the locomotive's main reservoir air supply is used to increase the intake manifold air supply and pressure to the engine's individual cylinders to help re-balance the combustion fuel/air ratio, thus reducing the smoke levels.

The invention includes an electronic module designed to use the locomotive engine's speed sensors to detect such changes in engine speed (rpm), as required by the locomotive operator moving the throttle notch handle. Once a speed change is detected, the module commands an air valve on each of the locomotive's main air reservoir tanks, (designed to handle the normal operating main reservoir air pressure), to open and allow them to discharge into the engine's intake manifolds located on both sides of the diesel engine.

The additional air pressure boost from the main reservoir tanks is needed for only a short amount of time, which will be confirmed during testing. Once the testing is completed, the electronic control module would then be programmed to open and close the air supply valve as needed.

Some conditions may require different time spans of increased boost due to the extent and level of the unacceptable smoke levels. Therefore, the module must be programmed to determine when these conditions will occur, based on the engine's speed or on the locomotive's trainline throttle position.

What is claimed is:

1. A method of reducing emissions for a locomotive comprising the steps of:

detecting a speed change of the locomotive, wherein the speed change corresponds to a change in a fixed throttle notch position of the locomotive;

signaling an air value; and discharging air from the locomotive's main reservoir air supply into an engine's intake manifold to reduce emissions.

* * * * *